United States Patent [19]

Bissett et al.

[11] Patent Number: 4,555,360

[45] Date of Patent: Nov. 26, 1985

[54] MILD DETERGENT COMPOSITIONS

[75] Inventors: Donald L. Bissett, Hamilton; Mark H. K. Mao, Cincinnati, both of Ohio

[73] Assignee: The Procter & Gamble Company, Cincinnati, Ohio

[21] Appl. No.: 623,817

[22] Filed: Jun. 22, 1984

[51] Int. Cl.[4] ..... C11D 1/75; C11D 1/83; C11D 1/90; C11D 1/94

[52] U.S. Cl. ..... 252/541; 252/545; 252/546; 252/547; 252/550; 252/551; 252/554; 252/555; 252/DIG. 5; 252/DIG. 7; 252/DIG. 13; 252/DIG. 14

[58] Field of Search ..... 252/526, 527, 528, 541, 252/545, 546, 547, DIG. 5, DIG. 7, DIG. 13, DIG. 14; 424/70

[56] References Cited

U.S. PATENT DOCUMENTS

| | | | |
|---|---|---|---|
| 3,755,559 | 8/1973 | Hewitt | 424/70 |
| 3,793,233 | 2/1974 | Rose | 252/547 |
| 3,849,348 | 11/1974 | Hewitt | 252/547 |
| 3,928,249 | 12/1975 | Nunziata | 252/526 |
| 3,950,417 | 4/1976 | Verdicchio | 252/545 |
| 3,963,649 | 6/1976 | Spadini | 252/546 |
| 4,003,857 | 1/1977 | Gorsich | 252/546 |
| 4,024,078 | 5/1977 | Gilbert | 252/551 |
| 4,137,191 | 2/1977 | Lohr | 252/153 |
| 4,144,201 | 3/1979 | Winterbotham | 252/547 |
| 4,166,048 | 8/1979 | Nishimura | 252/546 |
| 4,203,872 | 5/1980 | Flanagan | 252/542 |
| 4,287,102 | 9/1981 | Miyajima | 252/547 |
| 4,329,334 | 5/1982 | Su | 424/70 |
| 4,375,421 | 3/1983 | Rubin et al. | 252/110 |
| 4,396,525 | 8/1983 | Rubin et al. | 252/174.25 |
| 4,426,310 | 1/1984 | Verunica | 252/106 |

FOREIGN PATENT DOCUMENTS

| | | |
|---|---|---|
| 45-28905 | 9/1970 | Japan . |
| 50-076106 | 6/1975 | Japan . |
| 59-5107 | 1/1984 | Japan . |
| 59-39812 | 3/1984 | Japan . |
| 1128836 | 10/1968 | United Kingdom . |
| 1306969 | 2/1973 | United Kingdom . |
| 1452708 | 10/1976 | United Kingdom . |
| 2103236 | 2/1983 | United Kingdom . |

OTHER PUBLICATIONS

A Formulary of Detergents and Other Cleaning Agents, Compiled by Michael and Irene Ash, Chemical Publishing Co.—1980, pp. 6, 7, 56 and 57.

*Primary Examiner*—Dennis L. Albrecht
*Attorney, Agent, or Firm*—Robert B. Aylor; Richard C. Witte; Thomas H. O'Flaherty

[57] ABSTRACT

Mild detergent compositions comprise mild, water soluble, foaming anionic detergent surfactants and a mixture of small amounts of betaine surfactant and amine oxide suds booster.

2 Claims, No Drawings

MILD DETERGENT COMPOSITIONS

TECHNICAL FIELD AND BACKGROUND ART

The invention relates to mild detergent compositions containing mild detergent surfactants and a mixture of a low level of betaine surfactant and an amine oxide suds booster for consumer preferred skin condition.

Mild detergent compositions are well known in the art. Typically mildness is achieved by the use of sulfates of highly ethoxylated alcohols, see e.g. U.S. Pat. No. 3,743,233, Rose & Thiele, incorporated herein by reference. Betaines have also been suggested for use in compositions for washing dishes, see e.g., U.S. Pat. No. 4,166,048, Nishimura et al and U.S. Pat. No. 4,137,191. All of said patents are incorporated herein by reference.

SUMMARY OF THE INVENTION

The present invention relates to a mild foaming detergent composition comprising:

(1) from about 5% to about 99% of mild, water soluble, foaming anionic detergent surfactant selected from the group consisting of: compounds having the formula $RE_xS$ wherein R is an alkyl group containing from about 10 to about 18 carbon atoms or an alkyl phenyl group in which the alkyl contains from about 5 to about 13 carbon atoms, E represents an ethylene oxide moiety, x is a number from about 1 to about 20 on the average, and S is a neutralized sulfate group; $C_{12-18}$ olefin sulfonates; $C_{12-18}$ olefin sulfates; $C_{10-16}$ alkylglycerylether sulfonates; and mixtures thereof;

(2) from about 1% to about 30% of a surfactant having the formula $$R-\overset{(+)}{N}(R^1)_2-R^2\overset{(-)}{COO}$$

wherein R contains from about 12 to about 20 carbon atoms, $R^1$ contains from one to about 3 carbon atoms and $R^2$ contains from one to about 6 carbon atoms; and (3) from about 0.5% to about 20% of an amine oxide suds booster, and wherein, when said composition contains harsh surfactants such as $C_{10-16}$ alkyl sulfates and $C_{6-13}$ alkyl benzene sulfonates, said harsh surfactants are complexed with the amine oxide compound to make them milder.

DETAILED DESCRIPTION OF THE INVENTION

The detergent compositions of the present invention contain three essential components:

(1) mild, water soluble, foaming anionic detergent surfactant;

(2) low level of betaine detergent surfactant; and (3) an amine oxide suds booster.

Optional ingredients can be added to provide various performance and aesthetic characteristics.

THE MILD, WATER SOLUBLE, FOAMING ANIONIC DETERGENT SURFACTANT

The compositions of this invention contain from about 5% to about 99%, preferably from about 10% to about 40%, most preferably from about 20% to about 35% of mild, water soluble, foaming detergent surfactant.

The preferred mild anionic detergent surfactants have the generic formula $RE_xSM$ wherein R is an alkyl group containing from about 10 to about 18 carbon atoms, preferably from about 12 to about 15 carbon atoms, or, less preferred, an alkyl phenyl group in which the alkyl group contains from about 10 to about 18 carbon atoms, preferably from about 11 to about 14 carbon atoms, E represents an ethylene oxide moiety, x is a number from about 1 toabout 20 on the average, preferably from about 1 to about 12, S is a sulfate group, and M is an alkali metal, alkaline earth metal, ammonium or substituted ammonium cation.

An example of the preferred anionic synthetic detergent is the sodium, ammonium, potassium, or magnesium alkylpolyethoxylate sulfate, or mixtures thereof, obtained by sulfating the reaction product of higher alcohols containing from about 10 to about 15 carbon atoms, with from about 1 to about 20 [$C_{10-15}AE(1-20)S$], preferably from about 2 to about 12 [$C_{10-15}AE(2-12)S$] moles of ethylene oxide per mole of alcohol.

Other suitable mild detergent surfactants include sodium, potassium, magnesium, ammonium, or substituted ammonium (e.g., monoethanolammonium, diethanolammonium, or triethanolammonium) olefin sulfonates, or mixtures thereof, containing from about 12 to about 18 carbon atoms, or the corresponding olefin sulfates. Preferably, these olefin sulfonates or sulfates, contain from about 12 to about 16 carbon atoms.

Another suitable anionic detergent surfactant is an alkylglycerylether sulfonate in the form of its sodium, potassium, magnesium, ammonium, or substituted ammonium salt, wherein the alkyl group contains from about 10 to about 18 carbon atoms, preferably from about 12 to about 16 carbon atoms.

Mixtures of all of the above detergent surfactants can be used. These mild detergent surfactants are essential to the end result, i.e., preparation of a mild detergent composition having a consumer preferred skin condition. When harsh detergent surfactants are used, the resulting irritation tends to mask the improved skin condition created by the second essential ingredient, the betaine detergent surfactant.

THE BETAINE DETERGENT SURFACTANT

The betaine detergent surfactant has the general formula:

$$R-\overset{(+)}{N}(R^1)_2-R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from one to about 3 carbon atoms; and $R^2$ is an alkylene group containing from one to about 6 carbon atoms.

Examples of preferred betaines are cetyl dimethyl betaine; cetyl amidopropyldimethyl betaine, tetradecyldimethyl betaine, tetradecylamidopropyldimethyl betaine, and docosyldimethylammonium hexanoate.

The betaine is present at a level of from about 0.5% to about 30% by weight of the formula, preferably from about 1% to about 15%, most preferably from about 1% to about 10%. The ratio of anionic detergent surfactants to the betaine is from about 1/1 to about 20/1, preferably from about 3/1 to about 10/1.

THE AMINE OXIDE SUDS BOOSTER

Suitable amine oxide suds boosters have the formula:

$$R^1—(OR^2)_n—N(R^3)_2 \rightarrow O$$

in which $R^1$ is an alkyl radical of from about 8 to about 18, preferably from about 10 to about 14, carbon atoms; $R^2$ is an alkylene or a hydroxy alkylene group containing 2 to 3, preferably 2, carbon atoms; n ranges from 0 to about 20, preferably 0; and each $R^3$ is selected from the group consisting of methyl, ethyl and hydroxyethyl radicals which can be joined, e.g., to form morpholine or pyridine rings; and mixtures thereof. The arrow in the formula is a conventional representation of a semipolar bond. Specific examples of amine oxide detergents include dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldiethylamine oxide, tetradecyldiethylamine oxide, hexadecyldiethylamine oxide, octadecyldibutylamine oxide, dodecyldibutylamine oxide, tetradecyldibutylamine oxide, octadecyldibutylamine oxide, bis(2-hydroxyethyl)dodecylamine oxide bis-(2-hydroxyethyl-3-dodecoxy-1-hydroxypropylamine oxide, (2-hydroxypropyl)methyltetradecylamine oxide, dimethyl-(2-hydroxydodecyl)amine oxide, 3,6,9-trioxoctadecyl dimethyl amine oxide and 3-dodecoxy-2-hydroxy propyl di(2-hydroxyethyl)amine oxide.

The product contains from about 0.5% to about 20%, preferably from about 1% to about 15%, most preferably from about 2% to about 10%, of amine oxide suds booster with the ratio of anionic surfactant to amine oxide being from about 2:1 to about 20:1, preferably from about 3:1 to about 8:1.

THE MILDNESS EFFECT

It is believed that the betaine functions primarily by providing a desquamatory action to the detergent composition. It is believed that the betaines remove damaged (e.g. dry) skin cells on the surface of the skin, thereby reducing the rough feel associated therewith. Since these damaged skin cells would naturally sluff off eventually, the effect is merely to accelerate the natural process. The betaine removes the effect of prior damage to the skin, giving the skin a fresher, more youthful appearance and feel. When the betaine is combined with a mild detergent composition that contains an amine oxide suds booster, the overall effect is to promote the health of the skin and to provide the consumer with a perceived mildness or skin feel/appearance advantage over other similar detergent compositions which do not contain the essential ingredients herein.

OPTIONAL COMPONENTS

In addition to the essential ingredients described hereinbefore, the compositions can contain other conventional ingredients, especially those associated with dishwashing compositions, shampoos and handwashing compositions, e.g., "liquid soaps".

Optional ingredients include harsh detergent surfactants such as $C_{10-16}$ alkyl sulfates and $C_{6-13}$ alkylbenzene sulfonates, so long as they are complexed with other ingredients, e.g., the amine oxides to form mild complexes.

The compositions can also contain mild, water soluble detergent surfactants such as nonionic detergent surfactants which may not foam and may even inhibit foaming. Such nonionic detergents are disclosed in U.S. Pat. No. 4,321,165, Smith et al (Mar. 23, 1982), incorporated herein by reference.

Other conventional optional ingredients which are usually used in additive levels of below about 5% include opacifiers, antioxidants, bactericides, dyes, perfumes, optical brighteners and the like.

Detergency builders can also be present in amounts from 0% to about 50%, preferably from about 2% to about 30%, most preferably from about 5% to about 15%. It is typical in mild detergent compositions to have no detergent builder present.

The composition can also have pH regulants present. Desirably the pH of the composition in use is from about 5 to about 10, preferably from about 6 to about 9, most preferably from about 7 to about 8. Preferably, high pHs are avoided.

Other desirable ingredients include diluents and solvents. Diluents can be inorganic salts, such as sodium sulfate, ammonium chloride, magnesium chloride, sodium chloride, sodium bicarbonate, etc., and the solvents include water, lower molecular weight alcohols such as ethyl alcohol, isopropyl alcohol, etc. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, conventional hydrotropes such as ammonium toluene, xylene, or cumene sulfonates, etc.

All parts, percentages and ratios herein are by weight unless otherwise specified.

The following examples illustrate the invention.

EXAMPLE I

Three liquid detergents with the following compositions were tested in a hand soak test. In this test 18 panelists soak their hand in two different detergent solutions for four days, 30 minutes each day. Their hand conditions were graded by a qualified skin grader before and after the soakings. Data were then analyzed statistically. Detergent B was significantly milder than Detergents A and C.

| Composition % | A | B | C |
|---|---|---|---|
| Cetyl Dimethyl Betaine | 8.0 | 8.0 | 0.0 |
| Dodecyl Dimethyl Amine Oxide | 0.0 | 5.0 | 5.0 |
| $RE_xS$ ($R = C_{12,13}$, $X = 4.3$) | 27.0 | 27.0 | 27.0 |
| Relative Skin Grade Change* | Control | +0.50** | 0.00 |

*A is used as the control. Skin grades are based upon a standard dermatological scale in which 10 is perfect skin, normal skin ranges between 5 and 10, and the difference from one grade to the next grade is a very large, readily detectable difference.
**Significantly milder than A or C at the 95% confidence level.

EXAMPLE II

Two liquid detergent products with the specified compositions were distributed to 240 panelists for regular dishwashing. They were instructed to pay particular attention to mildness. Their opinions about the test detergent relative to their usual dishwashing liquid detergent were solicited two weeks later. Product A with betaine and amine oxide was significantly more preferred overall.

| Composition % | A | B |
|---|---|---|
| $RE_xS$ (R = $C_{12,13}$, X = 4.3) | 27.0 | 27.0 |
| Dodecyl Dimethyl Amine Oxide | 5.0 | 5.0 |
| Cetyl Dimethyl Betaine | 5.0 | 0.0 |
| Verbal Preference vs. own product | 57/43* | 46/54 |

*Significantly different from B at the 90% confidence level.

EXAMPLE III

Farm pigs were kept in low humidity environment for dry skin to develop. Different product solutions were then used to wash the dry skin. The removed skin flakes (scales) were collected by centrifugation and analyzed quantitatively by protein assay following a base hydrolysis step. The data shows good scale (skin flake) removal ability for formulas B and C.

| Composition % | A | B | C |
|---|---|---|---|
| $RE_xS$ | 27 | 27 | 27 |
| Dodecyl Dimethyl Amine oxide | 5 | 5 | 5 |
| Cetyl Dimethyl Betaine | 0 | 5 | 10 |
| μg of protein/4 $cm^2$ skin | 274 | 863 | 888 |

EXAMPLE IV

In a similar test as described in Example I, Lexaine P (Cetyl amido propyl betaine, Inolex Chemical Co.) and Lexaine LM (Coconut amido propyl betaine, Inolex Chemical Co.) were tested against cetyl dimethyl betaine. Results show that Lexaine P is directionally better than cetyl dimethyl betaine and that Lexaine LM is directionally worse than cetyl dimethyl betaine.

| Composition % | A | B | C |
|---|---|---|---|
| $RE_xS$ | 27 | 27 | 27 |
| Dodecyl Dimethyl Amine oxide | 5 | 5 | 5 |
| Cetyl Dimethyl Betaine | 5 | 0 | 0 |
| Lexaine P | 0 | 5 | 0 |
| Lexaine LM | 0 | 0 | 7.5 |
| Relative skin grade change* | Control | +0.55 | −0.23 |

*A is used as the control. Higher number indicates better skin conditions.

What is claimed is:

1. A mild foaming detergent composition comprising:

(1) from about 10% to about 40% of a mild, water-soluble, foaming anionic detergent surfactant having the generic formula $RE_xSM$ wherein R is an alkyl group containing from about 12 to about 15 carbon atoms; E represents an ethylene oxide moiety; x is a number from about 1 to about 12 on the average; S is a sulphate group; and M is selected from the group consisting of alkaline metal, alkaline earth metal, ammonium and substituted ammonium cation;

(2) from about 1% to about 10% of a surfactant selected from the group consisting of cetyl dimethyl betaine, cetyl amido propyldimethyl betaine, and mixtures thereof;

(3) from about 2% to about 10% of an alkyldimethylamine oxide suds booster wherein the alkyl group contains from about 10 to about 14 carbon atoms, wherein when said composition contains harsh surfactants such as $C_{10-16}$ alkyl sulfates and $C_{6-13}$ alkylbenzene sulfonates, said harsh surfactants are complexed with the amine oxide compound to make them milder, and wherein the ratio of (1) to (2) is from about 3:1 to about 10:1.

2. A mild foaming detergent composition comprising:

(1) from about 10% to about 40% of a mild, water-soluble, foaming anionic detergent surfactant having the generic formula $RE_xSM$ wherein R is an alkyl group containing from about 12 to about 15 carbon atoms; E represents an ethylene oxide moiety; x is a number from about 1 to about 12 on the average; S is a sulphate group; and M is selected from the group consisting of alkaline metal, alkaline earth metal, ammonium and substituted ammonium cation;

(2) from about 1% to about 10% of cetyl amido propyldimethyl betaine; and (3) from about 2% to about 10% of an alkyldimethylamine oxide suds booster wherein the alkyl group contains from about 10 to about 14 carbon atoms, wherein when said composition contains harsh surfactants such as $C_{10-16}$ alkyl sulfates and $C_{6-13}$ alkylbenzene sulfonates, said harsh surfactants are complexed with the amine oxide compound to make them milder, and wherein the ratio of (1) to (2) is from about 3:1 to about 10:1.

* * * * *

UNITED STATES PATENT AND TRADEMARK OFFICE

CERTIFICATE OF CORRECTION

PATENT NO. : 4,555,360

DATED : November 26, 1985

INVENTOR(S) : Donald L. Bissett, et al

It is certified that error appears in the above-identified patent and that said Letters Patent is hereby corrected as shown below:

Column 2, line 7, "toabout" should be --to about--.

Signed and Sealed this

*First* Day of *April 1986*

[SEAL]

*Attest:*

DONALD J. QUIGG

*Attesting Officer*

*Commissioner of Patents and Trademarks*